US006112128A

United States Patent [19]

Steinmetz

[11] Patent Number: 6,112,128

[45] Date of Patent: Aug. 29, 2000

[54] SYSTEM AND METHOD FOR PREDICTING THE OUTCOME OF COLLEGE FOOTBALL GAMES

[76] Inventor: Jeffrey G. Steinmetz, 1013 Falcon Head La., #201, Las Vegas, Nev. 89128

[21] Appl. No.: 09/327,647

[22] Filed: Jun. 8, 1999

[51] Int. Cl.[7] ..... A63F 9/24

[52] U.S. Cl. ..... 700/91; 700/93; 273/247; 473/438

[58] Field of Search ..... 700/91–93; 473/438, 473/415, 446, 447, 451, 459, 465–474, 409, 131; 273/277, 247, 244.2, 244.1, 244, 237, 460

[56] References Cited

U.S. PATENT DOCUMENTS

| | | | |
|---|---|---|---|
| 4,003,580 | 1/1977 | Haffey, Jr. | 273/134 |
| 4,141,548 | 2/1979 | Everton | 273/1 E |
| 4,496,148 | 1/1985 | Morstain et al. | 273/1 E |
| 4,592,546 | 6/1986 | Fascenda et al. | 273/1 E |
| 4,662,635 | 5/1987 | Enokian | 273/94 |
| 4,918,603 | 4/1990 | Hughes et al. | 364/410 |
| 5,462,275 | 10/1995 | Lowe et al. | 273/94 |
| 5,653,634 | 8/1997 | Hodges | 463/1 |
| 5,797,796 | 8/1998 | Dickinson | 463/43 |
| 5,860,862 | 1/1999 | Junkin | 463/40 |
| 5,971,854 | 10/1999 | Pearson et al. | 463/41 |
| 6,007,427 | 12/1999 | Wiener et al. | 463/17 |

*Primary Examiner*—Jessica J. Harrison
*Assistant Examiner*—Carmen White
*Attorney, Agent, or Firm*—Harry M. Weiss; Jeffrey Weiss; Paul W. Davis

[57] ABSTRACT

A system and method which uses statistical analysis of college football games to predict an outcome is comprised of a unique combination of objective, quantitative factors. The system and method accounts for when in the college football season the contest takes place and uses varying sets of objective parameters based on the season game number. The system and method may be implemented on a variety of processing platforms which allows for rapid analysis of multiple contests.

10 Claims, 2 Drawing Sheets

SYSTEM AND METHOD FOR PREDICTING THE OUTCOME OF COLLEGE FOOTBALL GAMES

BACKGROUND OF THE INVENTION

1. Field of the Invention

This invention relates generally to a system and method for predicting the outcome of sporting events, and more particularly the outcome of college football games. Specifically, the invention sets forth a system and progressively complex statistical method, which depends upon various historical parameters related to past performance, experience of team personnel and the Las Vegas college football line.

2. Description of the Related Art

The existing techniques for predicting the outcome of sporting events, such as for example, college football games, rely on a mix of quantitative and qualitative approaches. Quantitatively, such factors as won-loss records are considered. Qualitatively, the personalities and relatively strengths of coaches and players at key positions, such as quarterbacks, are factored in. The introduction of qualitative factors induces uncertainty into the prediction methodology.

Another limitation of previous prediction techniques has been the time consuming requirement to focus on each game individually. For each game, there is an overwhelming amount of historical performance information to digest. With literally hundreds of college football games being played each week during the fall football season, the ability to predict the outcome of a large number of games is diminished without an efficient means to concentrate on key statistical information.

Therefore, a need for a reliable system and method of predicting the outcome of college football games, independent of qualitative factors and without the burdensome task of analyzing vast amounts of statistical information is needed.

BRIEF SUMMARY OF THE INVENTION

It is an object of the present invention to provide an integrated system and method for predicting the outcome of a college football game.

It is another object of the present invention to provide an integrated system and method for predicting the outcome of a college football game that accounts for whether the football game takes place in a relatively early part of the season.

It is another object of the present invention to provide an integrated system and method for predicting the outcome of a college football game that accounts for whether the football game takes place in a relatively later part of the season.

It is another object of the present invention to provide an integrated system and method for predicting the outcome of a college football game that accounts for the relative experience level of the two competing football teams.

It is another object of the present invention to provide an integrated system and method for predicting the outcome of a college football game that accounts for the offensive "points scored by" differential between the two competing football teams.

It is another object of the present invention to provide an integrated system and method for predicting the outcome of a college football game that accounts for the defensive "points scored against" differential between the two competing football teams.

It is another object of the present invention to provide an integrated system and method for predicting the outcome of a college football game that accounts for the total points scored differential between the two competing football teams.

It is another object of the present invention to provide an integrated system and method for predicting the outcome of a college football game that accounts for the sports betting line as between the two competing football teams.

BRIEF DESCRIPTION OF THE PREFERRED EMBODIMENTS

In accordance with one embodiment of the present invention, a system if provided for predicting the outcome of college football games which includes means for entering a season game number for two competing college football teams; means for entering a number of returning starting players for each of the two college football teams; and means for predicting a winner of a college football game based on the number of returning starting players for each of the two competing college football teams.

In another embodiment of the present invention, a system for predicting the outcome of college football games includes means for entering a season game number for two competing college football teams; means for entering an offensive point average for each of the two college football teams; means for entering a defensive point average for each of the two competing college football teams; means for computing an offensive point differential; means for computing a defensive point differential; means for combining the offensive point differential and the defensive point differential resulting in a positive point differential; means for entering a betting line; means for combining the positive point differential with the betting line resulting in a prediction point; means for comparing the prediction point to a constant; and means for predicting a winner of a college football game based on whether the prediction point exceeds the constant.

A method for predicting the outcome of college football games comprises the steps of entering a season game number for two competing college football teams; entering a number of returning starting players for each of the two competing college football teams; predicting a winner of a college football game based on the number of returning starting players for each of the two competing college football teams.

Another method for predicting the outcome of college football games comprises the steps of entering a season game number for two competing college football teams; entering an offensive point average for each of the two competing college football teams; entering a defensive point average for each of the two competing college football teams; computing an offensive point differential; computing a defensive point differential; combining the offensive point differential and the defensive point differential resulting in a positive point differential; entering a betting line; combining the positive point differential with the betting line resulting in a prediction point; comparing the prediction point to a constant; and predicting a winner of a college football game based on whether the prediction point exceeds the constant.

The foregoing and other objects, features, and advantages of the invention will be apparent from the following, more particular, description of the preferred embodiments of the invention, as illustrated in the accompanying drawings.

DETAILED DESCRIPTION OF THE INVENTION

Figure 1:
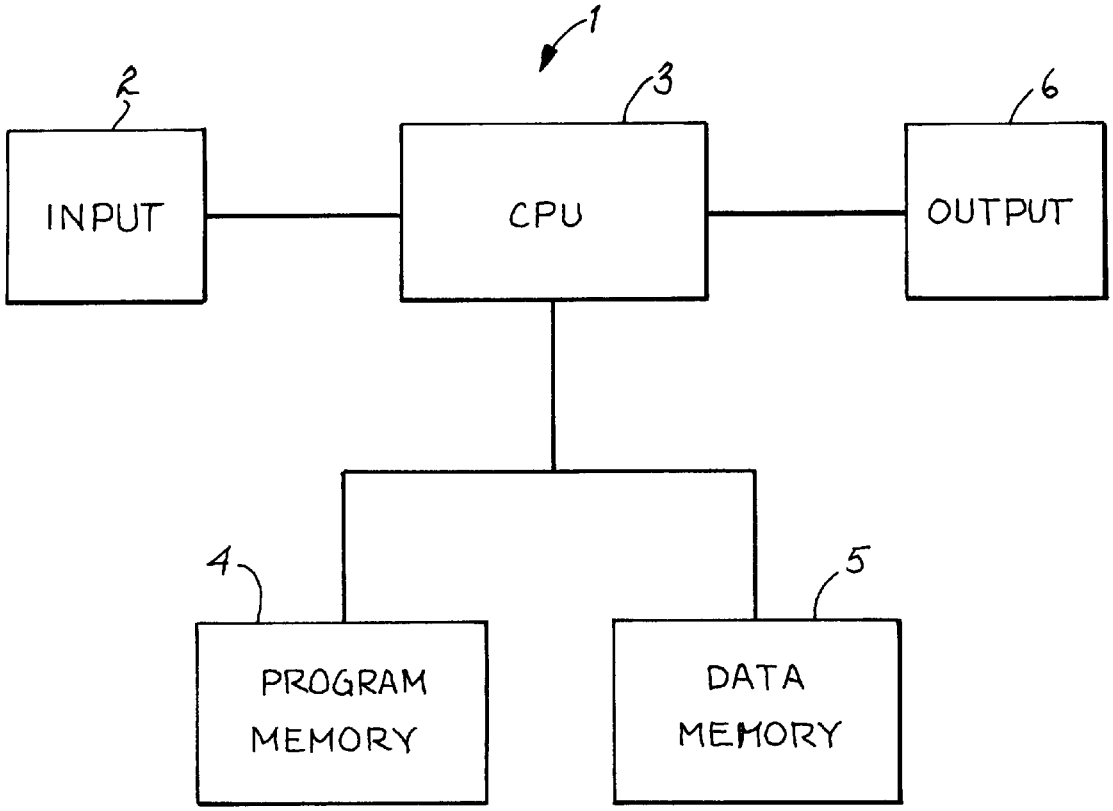
FIG. 1 is block diagram of one embodiment of a computer system that may host the process of the present invention.

Referring to FIG. 1, a hardware embodiment of a typical computer system 1, which may host the method or process for predicting the outcome of sporting events is illustrated. The basic requirements for the computer system for executing the method or process of the present invention are the same as for executing other typical computer software programs. Shown in FIG. 1 is an input device 2, such as a keypad, for inputing data. The computer system contains either volatile or non-volatile memory or a combination of both for storing data 5 and the executable software program 4 which comprises the method or process of the present invention. A central processing unit (CPU) 2 such as a microprocessor or microcontroller executes the method or process from program memory 4. Output devices 6 such as a video display and/or printer make available the results of the process.

Figure 2:
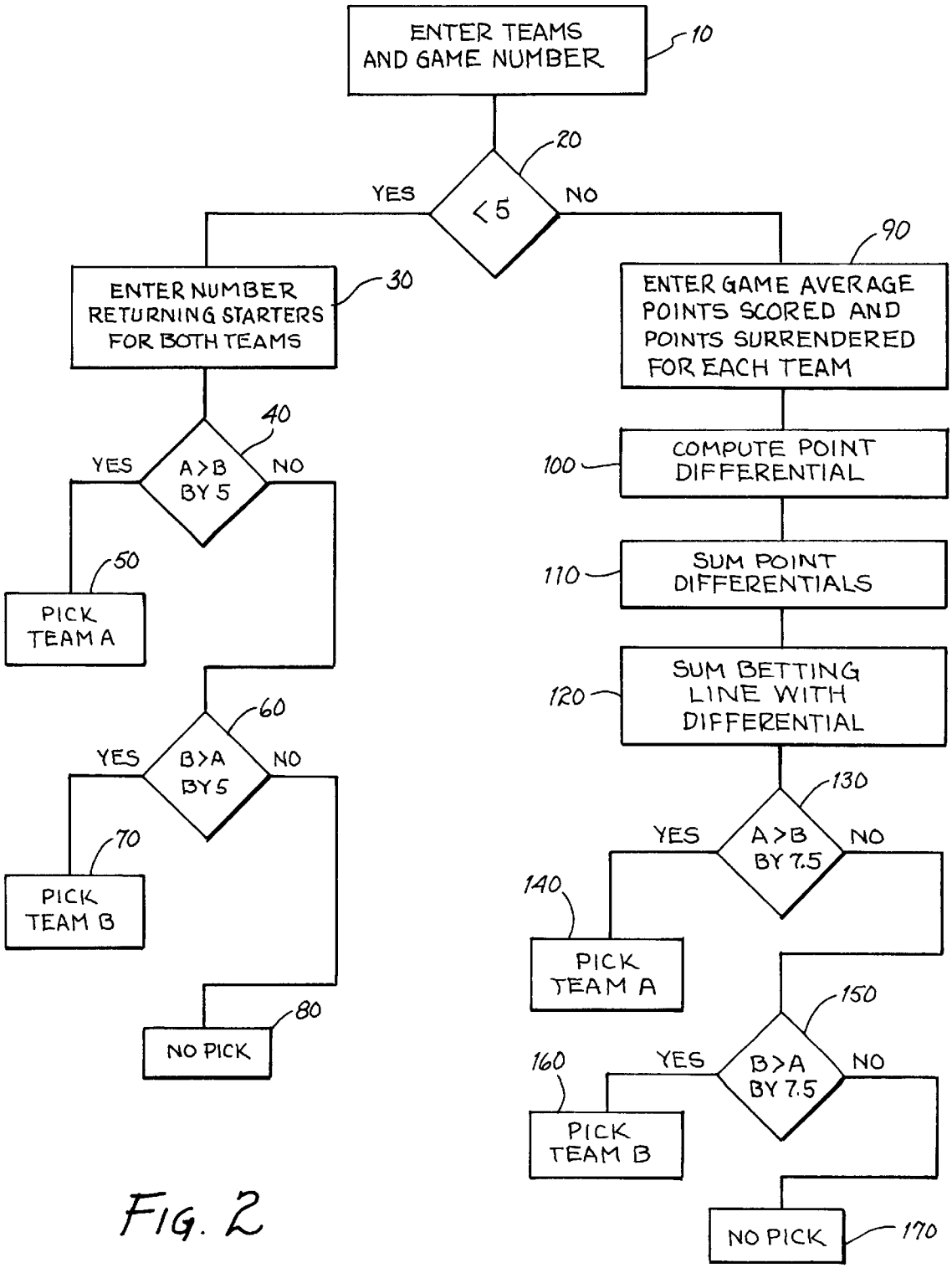
FIG. 2 is a flow chart which illustrates steps related to the method or process of the present invention.

Referring to FIG. 2, the process or flow chart for predicting the outcome of college football games is illustrated. The process is well suited for software implementation which may be executed on a wide variety of processing platforms or personal computers. Any number of hardware embodiments shown in FIG. 1 are possible, including a dedicated, handheld, battery operated, portable electronic or computer device that executes exclusively the program illustrated by the flow chart in FIG. 2. Another embodiment is a general personal computer, which would execute the software created by the flow chart of FIG. 2 as one of many possible application programs. Also, the method or process could be implemented on a central computer and offered by subscription to customers over the Internet.

The execution of the method or process is dependent, in part, on which game of the season is in question. If, for each of the two competing teams, the game in question is one of the first four games of the football season, then the method or process branches in one direction. If the game in question is game five or greater for each team, then the method or process branches in a second direction. Thus, the initial requirement is to enter the teams and the game number for each team 10, i.e. what number game of the season. Data may be entered in through a wide range of I/O devices such as keyboard, keypads, non-volatile memory, and download via communication ports. Data may be stored in either volatile or non-volatile memory which may be in form of semiconductor of magnetic media.

As shown in decision block 20 of FIG. 2, if the game number for each team is four or less, i.e. less than five, then the next input parameter is the number of returning starting players, regardless of position, for each team. Therefore, the next step in the process is to input the number of returning starting players 30, i.e. players who were starters during the previous year season, for Team A and Team B.

In dedication blocks 40 and 60, the system computes the difference of the number of returning starters and branches accordingly. System computation is accomplished by a typical microprocessor or microcontroller CPU. If the number of returning starters on Team A is six or more, i.e. greater than five, than the number of returning starters on Team B, then Team A is predicted to win the contest 50. If, however, the number of returning starters on Team B is six or more, i.e. greater than five, than the number of returning starters on Team A, then Team B is predicted to win the contest 70. If the difference is not greater than five for either team, then there is no prediction as to the outcome 80.

Returning to decision point 20, if the game number for each team is five or more, then the next input parameters for each team is the average of offensive points scored and the average of defensive points allowed or surrendered over the preceding games in the current season 90. For example, if Team A had scored a total of 180 points over 6 games, then the average of offensive points scored would be 30 points per game. Similarly if Team A had allowed a total of 120 points over 6 games, then the average of defensive points allowed would be 20 points per game.

The next step in the method or process is to compute the offensive and defensive positive point differentials 100 for each team. To continue the example from above, consider the case where Team A had an offensive point average of 30 and a defensive point average of 20. Also consider the case where, for example, Team B had an offensive point average of 25 and a defensive point average of 35. Incidently, this would mean that Team A, on average, won each game by 10 points and Team B, on average, lost each game by 10 points.

To compute the positive offensive and defensive point differentials, the method or process compares the respective averages. For example, for the offensive differential, Team A is 30 and Team B is 25, thus the offensive positive differential is +5 points in Team A's favor. For the defensive differential, Team A is 20 points allowed and Team B is 35 points allowed, thus the defensive positive differential is +15 in Team A's favor.

The next computational step is to sum the positive point differentials 110. To continue with the example, +5 offensive is summed with +15 defensive for a total of +20 positive point differential.

The next step is to factor in what is typically referred to as the betting line 120, e.g. the Las Vegas betting line. The betting line is the amount of points, according to oddsmakers, by which one team is expected to either win or lose by. For example if the betting line for the scenario described above was +5 for Team A, then Team A would be expected to beat Team by 5 points. Conversely, Team B would be expected to lose to Team A by 5 points. In the example and for the method or process defined by the present invention, the betting line is subtracted from the positive point differential resulting in a prediction point. Thus, the prediction point for the above situation is 20−5=15 in Team A's favor.

As shown in decision blocks 130 and 150, the criteria for predicting the outcome of a college football game is to compare the prediction point with a constant of 7.5. If the prediction point is positive in one teams favor by more than 7.5, then that team is predicted to win the contest, i.e. for Team A 140 and for Team B 160. If the prediction point is not greater than 7.5 for either team, then an outcome is not predicted 170. In the above example, the prediction point of 15 is greater than 7.5 in Team A's favor. Thus, Team A is predicted to win the contest.

Constants other than 7.5 are possible. However, the lower the constant, the lower the correlation between the prediction and the actual outcome of the game.

Once all the data for each team is entered, the method or process can operate rapidly to predict a large number of outcomes of college football games on a weekly basis.

Tables 1–2 contain performance data relevant to the present invention from 1997 and 1998. Table 1 contains data particular to the returning starter strategy employed in the first four games of the football season. Tables 2.1 and 2.2 contain data particular to the prediction point strategy of games 5 and beyond in the football season. The performance data indicates a success rate of correctly predicting the outcome of approximately 75%.

TABLE 1

RETURNING STARTER STRATEGY

| TEAMS RETURNING STARTERS | STARTERS DIFFERENCE | VEGAS LINE | DATE PLAYED | SCORE W OR L |
|---|---|---|---|---|
| PENN ST(13) & PITT(8) | 5 | −32 | 9/6/97 | L 34–17 |
| OK ST(17) & SW LA(12) | 5 | −6 | 9/6/97 | W 31–07 |
| RICE(15) & AIR FORCE(10) | 5 | −7 | 9/6/97 | L 12–42 |
| LSU(17) & UTEP(12) | 5 | −36 | 9/6/97 | W 55–3 |
| USC(16) & FL ST(11) | 5 | +11 | 9/6/97 | W 7–14 |
| OHIO U(15) & MARYLAND(10) | 5 | +12 | 9/6/97 | W 21–14 |
| MICH ST(16) & MEMPHIS(11) | 5 | −19.5 | 9/13/97 | W 51–21 |
| CLEMSON(16) & FL ST(11) | 5 | +20 | 9/20/97 | W 28–35 |
| TEMPLE(17) & V TECH(12) | 5 | +23 | 9/20/97 | W 13–23 |
| MINN(16) & MEMPHIS(11) | 5 | +2 | 9/20/97 | W 20–17 |
| BYU(15) & AZ ST(10) | 5 | +8 | 9/20/97 | W 13–10 |
| MIAMI OH(14) & ARMY(9) | 5 | +3.5 | 9/27/97 | W 38–14 |
| UAB(17) & SW LA(12) | 5 | −22 | 9/27/97 | W 42–07 |
| MARSHALL(13) & BALL ST(8) | 5 | −21 | 9/27/97 | W 42–16 |
| AKRON(19) & MARSHALL(14) | 5 | +16.5 | 9/5/98 | W 16–27 |
| AKRON(19) & TEMPLE(14) | 5 | +9.5 | 9/12/98 | W 35–28 |
| CAL(17) & NEBRASKA(12) | 5 | +22 | 9/12/98 | W 03–24 |
| MEMPHIS(17) & MISS ST(12) | 5 | +10.5 | 9/12/98 | W 06–14 |
| MINN(16) & HOUSTON(11) | 5 | +3 | 9/12/98 | W 14–07 |
| ARK(18) & SMU(13) | 5 | −9.5 | 9/19/98 | W 44–17 |
| GEORGIA(10) & WYOMING(15) | 5 | +19 | 9/19/98 | W 16–9 |
| LSU(16) & IDAHO(11) | 5 | −34.5 | 9/26/98 | L 53–20 |
| MIAMI OH(14) & BALL ST(8) | 6 | −14 | 8/30/97 | W 27–10 |
| MARSHALL(15) & ARMY(9) | 6 | +3 | 9/6/97 | W 35–25 |
| B GREEN(20) & MIAMI OH(14) | 6 | +10 | 9/6/97 | W 28–21 |
| VANDY(16) & ALABAMA(10) | 6 | +12 | 9/11/97 | L 00–20 |
| C FL(17) & NEB(11) | 6 | +43 | 9/13/97 | W 24–38 |
| TEX A&M(18) & SW LA(12) | 6 | −38 | 9/20/97 | W 66–00 |
| PURDUE(17) & N. WESTERN(11) | 6 | −3.5 | 9/27/97 | W 21–09 |

TABLE 2.1

THREE FACTOR STRATEGY

| TEAMS | VEGAS LINE | PPOINT DIFFERENTIAL | DATE PLAYED | SCORE W OR L |
|---|---|---|---|---|
| TULANE & SYRACUSE | +23 | +26 | 9/20/97 | W 19–30 |
| NAVY & NOTRE DAME | +17 | +27 | 11/1/97 | W 17–21 |
| WYOMING & COLORADO | +14.5 | +41.5 | 9/27/97 | W 19–20 |
| E. MICHIGAN & OHIO U | +13.5 | +16.5 | 10/5/98 | W 21–49 |
| UTAH ST. & BYU | +13.5 | +26.5 | 10/3/97 | W 35–42 |
| ARMY & BOSTON COLLEGE | +13.5 | +15.5 | 11/22/97 | W 20–24 |
| TEXAS & RICE | +12.5 | +20.5 | 9/27/97 | W 38–31 |
| ARK ST. & MEMPHIS | +12 | +14 | 10/31/98 | L 19–35 |
| WAKE FOREST & E. CAROLINA | +12 | +26 | 9/13/97 | W 24–25 |
| BYU & SMU | +11 | +15 | 9/27/97 | W 19–16 |
| NOTRE DAME & PITTSBURGH | +10.5 | +25.5 | 10/11/97 | L 45–21 |
| WAKE FOREST & VIRGINIA | +10 | +18 | 10/4/97 | W 13–21 |
| OREGON & UCLA | +10 | +18 | 10/17/98 | W 38–41 |
| E. CAROLINA & ALABAMA | +9.5 | +16.5 | 10/17/98 | W 22–23 |
| INDIANA & MICHIGAN ST. | +9.5 | +19.5 | 11/11/98 | W 31–38 |
| GEORGIA & TENNESSEE | +9.5 | +33.5 | 10/11/97 | L 13–38 |
| IDAHO & C. FLORIDA | +9.5 | +43.5 | 9/20/97 | L 10–41 |
| AKRON & BOWLING GREEN | +7.5 | +13.5 | 11/5/98 | L 21–58 |
| PITT & N. CAROLINA | +7.5 | +16 | 10/8/98 | L 10–29 |
| C MICH. & E MICH. | +6.5 | +10.5 | 11/11/98 | W 36–23 |
| TEXAS & OKLAHOMA ST. | +6 | +37 | 10/4/97 | W 16–42 |
| MISSISSIPPI & ALABAMA | +6 | +16 | 10/10/98 | W 17–20 |
| C. FLORIDA & AUBURN | +5.5 | +28.5 | 11/7/98 | W 6–10 |
| W MICH. & VANDERBILT | +5 | +25 | 10/10/98 | W 27–24 |
| PITT & BOSTON COLLEGE | +4.5 | +16.5 | 11/1/97 | W 21–22 |
| IOWA & OHIO ST. | +4 | +29 | 10/4/97 | L 7–23 |
| VANDY & MISSISSIPPI | +4 | +11 | 9/27/97 | L 03–15 |
| NEW MEX & SD ST. | +4 | +33 | 10/11/97 | W 36–31 |
| OKLAHOMA* & TEXAS | +4 | +15 | 10/11/97 | W 24–27 |
| MIAMI OH & ARMY | +3.5 | +11.5 | 9/27/97 | W 38–14 |
| TEXAS & MISSOURI | +3.5 | +13.5 | 10/18/97 | W 29–37 |

TABLE 2.1-continued

THREE FACTOR STRATEGY

| TEAMS | VEGAS LINE | PPOINT DIFFERENTIAL | DATE PLAYED | SCORE W OR L |
|---|---|---|---|---|
| MARSHALL & MISSISSIPPI | +3.5 | +20.5 | 12/26/97 | W 31–34 |
| WISCONSIN & MICHIGAN | +3.5 | +19.5 | 11/12/98 | L 10–27 |
| TCU & SMU | +3 | +12 | 10/17/98 | L 6–10 |
| TEXAS A&M & COLORADO | +3 | +56 | 10/4/97 | W 16–10 |
| TEXAS TECH & BAYLOR | +3 | +26 | 10/4/97 | W 35–14 |
| COLORADO & OK STATE* | +3 | +32 | 10/11/97 | W 29–33 |
| MEMPHIS & E. CAROLINA | +2.5 | +21.5 | 10/25/97 | L 10–32 |
| MINNESOTA & MEMPHIS | +2.5 | +11.5 | 9/20/97 | W 20–17 |
| MICH ST. & NOTRE DAME | +2.5 | +7.5 | 9/20/97 | W 23–07 |
| PITT & HOUSTON | +2.5 | +38.5 | 9/13/97 | W 35–24 |
| W. MICH & NE LOUIE | +1.5 | +12.5 | 11/15/97 | W 32–19 |
| HARVARD & CORNELL | +1 | +16 | 10/11/97 | W |
| OREGON ST. & STANFORD | PK | +19 | 10/10/98 | W 30–23 |
| AUBURN & MISS ST. | PK | +23 | 10/10/98 | W 38–21 |
| NEW MEX & UTAH ST. | −1 | +15 | 9/20/97 | W 25–22 |
| TEX A&M & KANSAS ST. | −1 | +17 | 10/18/97 | L 17–36 |
| S. MISS & ALABAMA | −1.5 | +14.5 | 10/31/98 | L 20–30 |
| ALABAMA & MISS ST. | −2 | +11 | 11/14/98 | W 14–26 |
| TULANE & LOUISVILLE | −2 | +23 | 10/11/97 | W 64–33 |
| CINN & E CAROLINA | −2 | +12 | 11/13/97 | L 7–14 |
| IDAHO & UTAH ST. | −2.5 | +15.5 | 10/17/98 | W 26–14 |
| V TECH & SYRACUSE | −2.5 | +28.5 | 9/13/97 | W 31–3 |
| AIR FORCE & WASHINGTON | −3 | +21 | 12/23/98 | W 45–26 |
| IDAHO & NORTH TEXAS | −3 | +18 | 10/31/98 | W 41–23 |
| MISSOURI & COL ST. | −3.5 | +15.5 | 12/28/97 | W 24–35 |
| ARKANSAS* & AUBURN | −3.5 | +23 | 10/31/98 | L 24–21 |
| FLORIDA & TENNESSEE | −4 | +22 | 9/20/97 | W 33–20 |
| AUBURN & LSU | −4.5 | +18.5 | 9/20/97 | L 31–28 |
| AIR FORCE & WYOMING | −4.5 | +17 | 11/14/98 | W 10–3 |
| ALABAMA & VIR TECH | −4.5 | +14.5 | 12/29/98 | W 38–07 |
| NE LOUIE & SW LOUIE | −5 | +11 | 10/25/97 | W 28–21 |
| TEX A&M & TEX TECH | −5 | +23 | 10/25/97 | L 13–16 |
| C MICH & AKRON | −5.5 | +15.5 | 10/4/97 | L 14–53 |
| GEORGIA & S. CAROLINA | −6 | +19 | 9/13/97 | W 31–15 |
| SMU & NEW MEX* | −6 | +18 | 10/4/97 | W 15–22 |
| ARMY & DUKE | −6 | +20 | 9/20/97 | L 17–20 |
| MISSOURI & TULSA | −6 | +24 | 9/20/97 | W 42–21 |
| WISCONSIN & IOWA | −6 | +17 | 10/4/98 | W 31–0 |
| KANSAS & TEX TECH | −6.5 | +12.5 | 11/1/97 | W 13–02 |
| B GREEN & AKRON | −6.5 | +15.5 | 9/20/97 | L 31–28 |
| ARKANSAS & SMU | −6.5 | +13.5 | 9/13/97 | L 9–31 |
| SD ST. & AIR FORCE | −7 | +22 | 9/27/97 | L 18–24 |
| NORTHWESTERN & RICE | −7 | +12 | 9/20/97 | L 34–40 |
| UAB & SW LA | −7 | +23 | 9/27/97 | W 42–07 |
| CINN & HOUSTON | −7.5 | +24.5 | 10/18/97 | L 38–41 |
| WASH ST & OREGON | −7.5 | +12.5 | 10/4/97 | W 24–13 |
| FRES ST & SAN JOSE ST | −7.5 | +11.5 | 11/1/97 | W 53–12 |
| ARKANSAS & S CAROLINA | −7.5 | +20.5 | 10/17/98 | W 41–28 |
| BYU & AZ ST. | −8 | +25 | 9/20/97 | L 13–10 |
| NEW MEX & TCU | −8 | +17 | 11/1/97 | W 40–10 |
| AKRON & KENT | −8 | +18 | 11/11/98 | W 45–16 |
| IDAHO & N TEX | −8 | +11 | 10/4/97 | W 30–17 |
| TOLEDO & E MICH | −8.5 | +21.5 | 9/13/97 | L 38–35 |
| IOWA & WISCONSIN | −8.5 | +16.5 | 11/8/97 | L 10–13 |
| KANSAS ST & OKLAHOMA | −9.5 | +11.5 | 10/25/97 | W 26–07 |
| TULANE & HOUSTON | −9.5 | +17.5 | 11/22/97 | W 44–10 |
| W VIR & MARYLAND | −9.5 | +17.5 | 10/11/97 | W 31–14 |
| TOLEDO & C MICH | −10 | +17 | 10/11/97 | W 41–10 |
| LSU & MISS ST | −10 | +37 | 9/13/97 | W 24–09 |
| TOLEDO & B GREEN | −10 | +19 | 10/25/97 | W 35–20 |
| OHIO U & MIAMI OH | −10 | +11 | 10/31/98 | W 21–35 |
| USC & STANFORD | −10 | +13 | 11/7/98 | W 34–9 |
| HOUSTON & CINN | −10 | +13 | 11/14/98 | L 43–44 |
| E CAROLINA & TULANE | −10.5 | +23.5 | 10/18/97 | W 16–33 |
| MISS ST & GEORGIA | −10.5 | +14.5 | 10/4/97 | W 00–47 |
| PURDUE & ILLINOIS | −11 | +22 | 10/25/97 | W 48–03 |
| NEBRASKA & KANSAS ST* | −11 | +12 | 11/24/98 | L 30–40 |
| ARIZONA & CAL | −11 | +15 | 11/14/98 | L 27–23 |
| UCLA & OREGON | −11.5 | +14.5 | 10/11/97 | L 39–31 |
| MARSHALL & B GREEN | −12 | +13 | 10/31/98 | L 13–34 |
| AIR FORCE & ARMY | −12 | +17 | 11/5/98 | W 35–07 |
| PITT & RUTGERS | −12.5 | +18.5 | 10/25/97 | L 55–48 |
| ILLINOIS & WISCONSIN | −13 | +15 | 10/11/97 | W 07–31 |
| MICH ST & NORTHWESTERN | −13 | +15 | 10/18/97 | L 17–19 |
| KANSAS ST. & MISSOURI | −13.5 | +15.5 | 11/21/98 | L 31–25 |

TABLE 2.1-continued

THREE FACTOR STRATEGY

| TEAMS | VEGAS LINE | PPOINT DIFFERENTIAL | DATE PLAYED | SCORE W OR L |
|---|---|---|---|---|
| OREGON & WASH ST | −13.5 | +22.5 | 10/10/98 | W 51–29 |
| E CAROLINA & CINN | −14 | +14 | 11/5/98 | L 21–24 |
| NOTRE DAME & MICH | −14 | +23 | 9/27/97 | L 14–21 |
| MARSHALL & BALL ST | −14 | +12 | 9/27/97 | W 42–16 |
| MIAMI OH & CINN | −14.5 | +19.5 | 10/24/98 | W 41–0 |
| COL ST & SD ST | −14.5 | +11.5 | 11/22/97 | W 38–17 |
| PURDUE & INDIANA | −15 | +11 | 11/22/97 | W 56–07 |
| ARKANSAS* & MEMPHIS | −15 | +27 | 10/10/98 | L 23–09 |
| TEXAS A&M & OKLAHOMA | −15 | +20 | 11/13/97 | W 51–07 |
| DARTMOUTH & YALE | −15 | +22 | 10/18/97 | L |
| PENN ST & NORTHWESTERN | −16 | +13 | 11/1/97 | L 30–27 |
| TEXAS & TEXAS A&M | −16 | +16 | 11/28/97 | L 16–27 |
| LSU & VANDY | −16 | +12 | 10/4/97 | L 07–06 |
| NEW MEX & UTEP | −16.5 | +65.5 | 9/13/97 | W 38–20 |
| IOWA ST & MISSOURI | −17 | +16 | 10/4/97 | W 21–45 |
| TULANE & MEMPHIS | −17 | +12 | 11/7/98 | L 41–31 |
| KANSAS ST & COLORADO | −17 | +26 | 10/10/98 | L 16–09 |
| OREGON ST & SAN JOSE ST | −18 | +15 | 10/4/97 | L 26–12 |
| WISCONSIN & MINNESOTA | −18 | +13 | 10/17/98 | W 26–07 |
| B GREEN & OHIO U | −18 | +17 | 10/18/97 | W 00–24 |
| NAVY & AIR FORCE | −18 | +17 | 10/10/98 | W 07–49 |
| BOSTON C & V TECH | −18.5 | +12.5 | 10/11/97 | L 07–17 |
| MICH ST & INDIANA | −19 | +18 | 10/11/97 | W 38–06 |
| SMU & AIR FORCE | −19 | +11 | 10/31/98 | W 07–31 |
| MIAMI OH & KENT | −20 | +11 | 10/11/97 | W 62–26 |
| HARVARD & YALE | −20 | +13 | 11/22/97 | W |
| OKLA ST & KANSAS ST | −20 | +27 | 10/17/98 | W 20–52 |
| WISCONSIN & ILLINOIS | −20.5 | +14.5 | 10/17/98 | W 37–03 |
| MARSHALL & C MICH | −21 | +13 | 11/1/97 | W 45–17 |
| NEBRASKA & COL | −21 | +11 | 11/28/97 | L 27–24 |
| BAYLOR & TEXAS A&M | −21 | +11.5 | 11/8/97 | W 10–38 |
| COL ST & SAN J ST | −22 | +17 | 10/11/97 | W 55–20 |
| OHIO U & N ILL | −23 | +19 | 11/1/97 | L 35–30 |
| N CAROLINA & MARYLAND | −23.5 | +19.5 | 9/20/97 | W 49–14 |
| KANSAS ST* & IOWA ST. | −24 | +20 | 11/22/97 | W 28–03 |
| LA TECH & SW LA | −24 | +14 | 11/15/97 | W 63–24 |
| KANSAS ST & KANSAS | −25 | +22 | 10/31/98 | W 54–06 |
| PENN ST & ILLINOIS | −25.5 | +13.5 | 10/4/97 | W 41–06 |
| N CAROLINA & TCU | −26 | +13 | 10/4/97 | L 31–10 |
| C. FL & SW LA | −26 | +14 | 10/24/98 | W 42–10 |
| INDIANA & IOWA | −26 | +19 | 10/25/97 | W 00–62 |
| MICH & BAYLOR | −26.5 | +11.5 | 9/20/97 | W 38–03 |
| UTEP & UTAH | −27 | +12 | 9/20/97 | W 06–56 |
| IOWA & IOWA ST | −28 | +62 | 9/20/97 | W 63–20 |
| KANSAS ST & BAYLOR | −28 | +24.5 | 11/7/98 | W 49–06 |
| WYOMING & SAN J ST | −29 | +25 | 9/20/97 | L 30–10 |
| IOWA ST & TEXAS A&M | −33 | +33 | 10/11/97 | W 56–17 |
| SYRACUSE & RUTGERS | −33.5 | +10.5 | 10/9/97 | W 50–03 |
| TEXAS A&M & SW LA | −38 | +49 | 9/20/97 | W 66–00 |

TABLE 2.2

TAIL WAGGING FACTOR DOGS

| TEAMS | VEGAS LINE | PPOINT DIFFERENTIAL | DATE PLAYED | SCORE W OR L |
|---|---|---|---|---|
| NOTRE DAME & STANFORD | +1 | +13 | 10/04/97 | W 15–33 |
| VIR TECH & W VIRGINIA | +1 | +8 | 10/25/97 | L 17–30 |
| OREGON & ARIZONA | +2 | +9 | 10/13/98 | L 03–38 |
| W MICH* & E. MICH | +2 | +8 | 11/01/97 | W 41–38 |
| NEW MEX & UTAH | +2.5 | +10.5 | 10/25/97 | L 10–15 |
| WASH ST & AZ ST | +3 | +9 | 11/01/97 | L 31–44 |
| G. TECH & GEORGIA | +3 | +8 | 11/28/98 | N 21–19 |
| MARSHALL* & MISSISSIPPI | +3.5 | +20.5 | 12/26/97 | W 31–34 |
| MIAMI FL & SYRACUSE | +3.5 | +9.5 | 11/28/98 | L 13–66 |
| MISSOURI & W VIR* | +3.5 | +8.5 | 12/26/98 | W 34–31 |
| MARSHALL & LOUISVILLE | +3.5 | +11.5 | 12/23/98 | W 48–29 |
| W MICH & B GREEM | +4 | +10 | 10/11/97 | W 34–21 |
| KANSAS & CINN | +4 | +18 | 09/20/97 | L 07–34 |
| BOISE ST & NEW MEX ST | +4 | +11 | 11/07/98 | W 55–51 |
| OKLAHOMA & BAYLOR | +4 | +8 | 11/14/98 | W 28–16 |
| UTAH & BYU | +4.5 | +7.5 | 11/22/97 | W 20–14 |

TABLE 2.2-continued

TAIL WAGGING FACTOR DOGS

| TEAMS | VEGAS LINE | PPOINT DIFFERENTIAL | DATE PLAYED | SCORE W OR L |
|---|---|---|---|---|
| TEXAS TECH & COLORADO | +5 | +10 | 10/17/98 | W 17–19 |
| W MICH & VANDY | +5 | +25 | 10/10/98 | W 27–24 |
| NE LA & HAWAII | +5.5 | +7.5 | 11/22/97 | W 23–20 |
| TCU & TULSA | +5.5 | +11.5 | 11/14/98 | W 17–07 |
| C FL & AUBURN | +5.5 | +28.5 | 11/07/98 | W 06–10 |
| KANSAS & BAYLOR | +6 | +13 | 10/10/98 | L 11–38 |
| MIAMI FL & BOSTON COLLEGE | +6 | +8 | 10/18/97 | W 45–44 |
| WASH ST & WASH | +6 | +13 | 11/22/97 | W 41–35 |
| MISS ST. & TEXAS | +6 | +10 | 01/01/98 | L 24–31 |
| KANSAS & TEXAS | +6.5 | +7.5 | 11/15/97 | L 31–45 |
| IOWA & MICH | +7 | +15 | 10/18/97 | N 24–28 |
| MISSISSIPPI ST & KENTUCKY | +7.5 | +13.5 | 11/07/98 | W 35–37 |
| LA TECH & AUBURN | +7.5 | +25.5 | 10/24/98 | L 17–32 |
| G. TECH & WAKE FOREST | +7.5 | +14.5 | 09/20/97 | W 28–26 |
| W VIR & MIAMI | +8 | +10 | 09/27/97 | W 38–17 |
| TEXAS TECH & TEXAS A&M | +9 | +18 | 10/22/98 | W 10–17 |
| TULSA & SMU | +9 | +9 | 11/07/98 | L 03–33 |
| UCLA & WISCONSIN | +9.5 | +17.5 | 01/01/99 | W 31–38 |
| ARK & TENNESSEE | +9.5 | +10.5 | 11/14/98 | W 24–28 |
| W VIR & NOTRE DAME | +10 | +13 | 11/22/97 | W 14–21 |
| NE LA & LA TECH | +10 | +9 | 09/13/97 | W 16–17 |
| NEW MEX & ARIZONA | +10 | +10 | 12/27/97 | W 14–20 |
| NOTRE DAME & PITT | +10.5 | +25.5 | 10/11/97 | L 45–21 |
| CAL & WASHINGTON | +10.5 | +8.5 | 10/17/98 | W 13–21 |
| AZ ST & OREGON ST | +11 | +10 | 09/25/97 | W 13–10 |
| TEX A&M & UCLA | +11 | +8 | 01/01/98 | W 23–29 |
| VIR TECH & N. CAROLINA | +11 | +9 | 01/01/97 | L 03–42 |
| OHIO U & MARSHALL | +11 | +8 | 11/15/97 | L 00–27 |
| BOISE ST & N TEX | +11 | +16 | 10/18/97 | W 17–14 |
| RUTGERS & NAVY | +11.5 | +7.5 | 11/07/98 | W 36–33 |
| CAL & ARIZONA | +12 | +9 | 11/15/97 | W 38–41 |
| LSU* & FLORIDA | +12.5 | +14.5 | 10/10/98 | W 10–22 |
| TEXAS A&M & UCLA | +13 | +10 | 01/01/98 | W 23–29 |
| WAKE F & E CAROLINA | +13 | +27 | 09/13/97 | W 24–25 |
| GEORGIA TECH & FL ST | +13 | +11 | 10/24/98 | L 07–34 |
| VANDY & S. CAROLINA | +13 | +10 | 10/25/97 | L 03–35 |
| COL ST & UTAH ST | +13.5 | +22.5 | 09/13/97 | W 35–24 |
| TCU & COL ST | +13.5 | +8.5 | 10/24/98 | L 21–42 |
| UTAH ST & BYU | +13.5 | +26.5 | 10/03/97 | W 35–42 |
| C. MICH & TOLEDO | +13.5 | +7.5 | 11/14/98 | W 14–17 |
| MISSOURI & COL | +14 | +12 | 11/01/97 | W 41–31 |
| INDIANA & MICH | +14 | +15 | 11/22/98 | W 10–22 |
| BOSTON C & NOTRE DAME | +14.5 | +12.5 | 10/25/97 | L 26–52 |
| TEMPLE & PITT | +14.5 | +7.5 | 11/07/98 | W 34–33 |
| LA TECH & ARK | +14.5 | +29.5 | 09/27/97 | W 13–17 |
| OR ST & OREGON | +15 | +10 | 11/22/97 | L 30–48 |
| N TEX & KANSAS | +15.5 | +12.5 | 11/07/98 | W 14–23 |
| AZ ST & WASHINGTON | +15.5 | +18 | 10/04/97 | W 14–26 |
| MIAMI FL & PITT | +15.5 | +13.5 | 01/18/97 | W 17–21 |
| BALL ST & PURDUE | +16 | +9 | 09/20/97 | W 14–28 |
| USC & TCU | +16 | +9 | 12/31/98 | W 19–28 |
| MARYLAND & N. CAROLINA | +16 | +9 | 11/05/98 | W 13–24 |
| KANSAS & COL | +16.5 | +21.5 | 10/08/97 | L 06–42 |
| DUKE & VIRGINIA | +16.5 | +7.5 | 10/08/97 | W 10–13 |
| NORTHWESTERN & HAWAII | +16.5 | +7.5 | 11/21/98 | L 21/47 |
| OREGON ST. & ARIZONA | +16.5 | +16.5 | 11/08/98 | L 07–27 |
| OREGON ST. & WASHINGTON | +17 | +15 | 10/24/98 | W 34–35 |
| NE LA & MISS ST | +17 | +16 | 10/11/97 | W 10–24 |
| IDAHO & S MISS | +17 | +9 | 12/30/98 | W 42–35 |
| N. ILL* & OHIO U | +17 | +8 | 11/14/98 | W 12–28 |
| UAB & LA TECH | +17.5 | +12.5 | 10/17/98 | L 23–54 |
| S MISS & TENNESSEE | +19 | +12 | 11/08/97 | L 20–44 |
| FRESNO ST & OREGON | +19 | +11 | 09/20/97 | W 40–43 |
| UAB & CINN | +19 | +10 | 10/11/97 | W 29–33 |
| LA TECH & ALABAMA | +19 | +17 | 11/01/97 | W 26–20 |
| MISSOURI & NEBRASKA | +19 | +9 | 10/22/98 | W 13–20 |
| FL ST & CLEMSON | +20 | +29 | 09/20/97 | W 35–28 |
| MISSISSIPPI & AUBURN | +20.5 | +14.5 | 09/13/97 | W 09–19 |
| GEORGIA & FL | +20.5 | +13.5 | 11/01/97 | W 37–17 |
| KANSAS ST & NEBRASKA | +21.5 | +31.5 | 10/04/97 | L 26–56 |
| S CAROL & TENNESSEE | +21.5 | +13.5 | 11/01/97 | W 07–22 |
| OR ST & UCLA | +22.5 | +8.5 | 10/18/97 | L 10–34 |
| HAWAII* & SD ST | +23 | +17 | 10/10/98 | W 13–35 |
| C FL & KENT ST | +23.5 | +8.5 | 10/04/97 | W 59–43 |
| ARMY & NOTRE DAME | +25 | +14 | 10/24/98 | W 17–20 |

TABLE 2.2-continued

TAIL WAGGING FACTOR DOGS

| TEAMS | VEGAS LINE | PPOINT DIFFERENTIAL | DATE PLAYED | SCORE W OR L |
|---|---|---|---|---|
| E MICH & MARSHALL | +25 | +9 | 10/25/97 | W 25–48 |
| SW LA & TEX TECH | +25.5 | +32.5 | 09/13/97 | L 14–59 |
| ARK ST. & MISSISSIPPI | +25.5 | +11.5 | 10/24/98 | W 17–30 |
| MISSISSIPPI & TENN | +26.5 | +20.5 | 10/04/97 | W 17–31 |
| N CAROLINA* & FL ST | +27 | +8 | 10/31/98 | W 13–39 |
| HAWAII & BYU | +27.5 | +25.5 | 10/18/97 | W 03–17 |
| HAWAII & COL ST | +30 | +39 | 10/04/97 | L 00–63 |
| ILLINOIS & PENN ST | +33.5 | +8.5 | 10/29/98 | W 00–27 |
| WAKE FOREST & FL ST | +34 | +10 | 11/15/97 | L 07–58 |
| TEX TECH & NEBRASKA | +36 | +18 | 10/18/97 | W 00–29 |
| VANDY & FL | +36.5 | +11.5 | 11/08/97 | W 17–20 |
| SW LA & OKLAHOMA ST | +37 | +14 | 11/14/98 | W 20–44 |
| TEMPLE & PENN ST | +37 | +13 | 09/11/97 | L 10–52 |
| HAWAII & MICHIGAN | +38.5 | +9.5 | 11/28/98 | W 17–48 |
| ARK ST & MIAMI FL | +40.5 | +21.5 | 11/01/97 | W 10–42 |
| UAB & TENNESSEE | +42 | +14 | 11/07/98 | W 13–37 |

Although the invention has been shown and described with reference to a preferred embodiment, it will be understood by those skilled in the art that changes in form and detail may be made without departing from the spirit and scope of the invention.

What is claimed is:

1. A system for predicting the outcome of college football games comprising, in combination:

means for entering a season game number for two competing college football teams;

means for entering a number of returning starting players for each of the two competing college football teams;

means for predicting a winner of a college football game based on the number of returning starting players for each of the two competing college football teams.

2. The system in accordance with claim 1 wherein the means for entering a season game number having a season game number less than five for each of the two competing college football teams.

3. The system in accordance with claim 1 wherein the predicting means relies on one of the two competing college football teams having at least five more returning starting players than the other of the two competing college football teams.

4. A system for predicting the outcome of college football games comprising, in combination:

means for entering a season game number for two competing college football teams;

means for entering an offensive point average for each of the two competing college football teams;

means for entering a defensive point average for each of the two competing college football teams;

means for computing an offensive point differential;

means for computing a defensive point differential;

means for combining the offensive point differential and the defensive point differential resulting in a positive point differential;

means for entering a betting line;

means for combining the positive point differential with the betting line resulting in a prediction point;

means for comparing the prediction point to a constant; and means for predicting a winner of a college football game based on whether the prediction point exceeds the constant.

5. The system in accordance with claim 4 wherein the means for entering a season game number having a season game number greater than four for each of the two competing college football teams.

6. A method for predicting the outcome of college football games comprising the steps of:

entering a season game number for two competing college football teams;

entering a number of returning starting players for each of the two competing college football teams;

predicting a winner of a college football game based on the number of returning starting players for each of the two competing college football teams.

7. The method in accordance with claim 6 wherein the step of entering the season game number enters a season game number that is less than five for each of the two competing college football teams.

8. The method in accordance with claim 6 wherein the step of predicting relies on one of the two competing college football teams having at least five more returning starting players than the other of the two competing college football means.

9. A method for predicting the outcome of college football games comprising the steps of:

entering a season game number for two competing college football teams;

entering an offensive point average for each of the two competing college football teams;

entering a defensive point average for each of the two competing college football teams;

computing an offensive point differential;

computing a defensive point differential;

combining the offensive point differential and the defensive point differential resulting in a positive point differential;

entering a betting line;

combining the positive point differential with the betting line resulting in a prediction point;

comparing the prediction point to a constant; and predicting a winner of a college football game based on whether the prediction point exceeds the constant.

10. The method in accordance with claim 9 wherein the season game number is greater than four for each of the two competing college football teams.

* * * * *